United States Patent [19]

Hanyu et al.

[11] Patent Number: 4,638,751

[45] Date of Patent: Jan. 27, 1987

[54] SEWING MACHINE WITH A DEVICE FOR SETTING THREAD TENSION

[75] Inventors: Susumu Hanyu; Kazumasa Hara, both of Tokyo; Akiyoshi Sasano, Musashino; Mikio Koike, Oume, all of Japan

[73] Assignee: Janome Sewing Machine Co., Ltd., Tokyo, Japan

[21] Appl. No.: 773,198

[22] Filed: Sep. 3, 1985

[30] Foreign Application Priority Data

Aug. 31, 1984 [JP] Japan ..... 59-180421

[51] Int. Cl.[4] ..... D05B 63/00; D05B 47/02

[52] U.S. Cl. ..... 112/254; 112/229

[58] Field of Search ..... 112/254, 229, 233

[56] References Cited

U.S. PATENT DOCUMENTS

| | | | |
|---|---|---|---|
| 3,408,832 | 11/1968 | Abe et al. | 112/254 X |
| 4,098,208 | 7/1978 | Hedegaard | 112/254 X |
| 4,301,757 | 11/1981 | Tonomura | 112/254 |
| 4,340,003 | 7/1982 | Hanyu et al. | 112/254 X |
| 4,377,980 | 3/1983 | Hanyu et al. | 112/229 X |
| 4,429,649 | 2/1984 | Eguchi et al. | 112/229 |
| 4,466,368 | 8/1984 | Hanyu et al. | 112/254 |

*Primary Examiner*—Werner H. Schroeder
*Assistant Examiner*—Andrew M. Falik
*Attorney, Agent, or Firm*—Michael J. Striker

[57] ABSTRACT

A tension setting device of the sewing machine comprises an upper thread tension device on the machine frame. A selecting device for selecting a thread tension in response to a thickness of a fabric being sewn is mounted to the machine frame. An auxiliary upper thread tension device cooperating with the selecting device and actuated thereby to adjust upper thread tension in response to the thickness of the fabric is provided in the tension setting device. A lower thread adjusting device cooperates with the thread tension selecting device to adjust the lower thread in response to the thickness of the fabric being sewn.

5 Claims, 17 Drawing Figures

SEWING MACHINE WITH A DEVICE FOR SETTING THREAD TENSION

BACKGROUND OF THE INVENTION

This invention relates to a device for properly setting a thread tension of a sewing machine by operation in response to conditions of a fabric to be sewn and a thread to be used.

With respect to various stitching conditions, an upper thread tension and a lower thread tension or a lower thread supplying amount are set to predetermined stitching conditions such that desired stitches may be produced by operation of fabric thickness selecting buttons (called briefly as "fabric sort button" hereinafter).

In sewing machines generally used, an operator adjusts an upper thread tension device so as to make proper crossing positions of the stitches of the upper and lower threads in accordance with data from the type of fabric, thread, feed amount, and thread tension being used. There have been many proposals for methods for automating the selection of the upper thread tension, however they have not taken into consideration the type of fabric and thread being used.

In some known sewing machines, complex devices for setting thread tension comprise an adjusting cam operating connected to pattern cams. A linkage which is connected to the adjusting cam and to a control cam is operated to adjust a lower thread tension in accordance with a respective pattern cam.

SUMMARY OF THE INVENTION

An object of the invention is to make a thread tension optimal in response to the thickness of the fabric to be sewn and the thickness of the thread to be penetrated thereinto. A thread tension device of a sewing machine is proposed herein, which may set the optimal thread tension in response to the thickness of the fabric and the thickness of the thread, especially so as to obtain the thread tension which would prevent shrinkage which is caused by stitching a thin fabric.

The objects of the invention are attained by a sewing machine of the type having a machine frame, upper thread supply means, lower thread supply means, and means for setting thread tension which comprise main upper thread tension means on said frame; selecting means for selecting a thread tension in response to a thickness of a fabric being sewn and mounted to the machine frame; auxiliary upper thread tension means on said frame and operatively connected to said selecting means and actuated thereby to adjust upper thread tension in response to the thickness of the fabric; and lower thread adjusting means operatively connected to said selecting means to adjust the lower thread in response to the thickness of the fabric being sewn, whereby thread tension is set to predetermined stitching conditions.

DETAILED DESCRIPTION OF THE PREFERRED EMBODIMENTS

Explanations will be made in detail with reference to the attached drawings.

Figure 1:
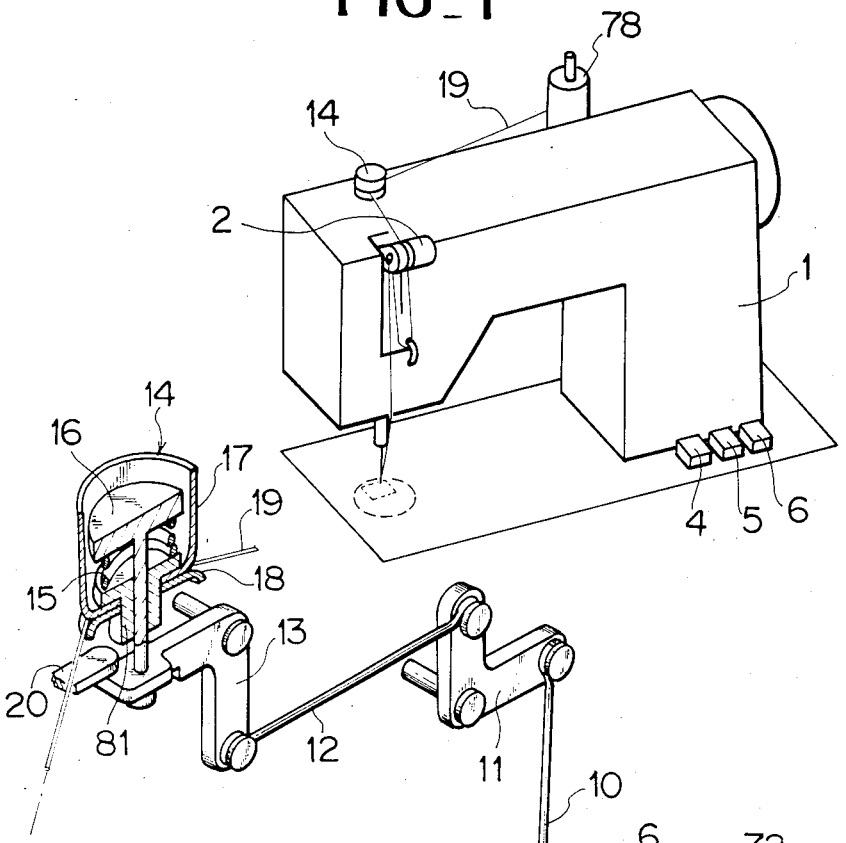
FIG. 1 is a schematic perspective view of a sewing machine, showing outer operating parts thereof according to a first embodiment of the invention.
Figure 2:
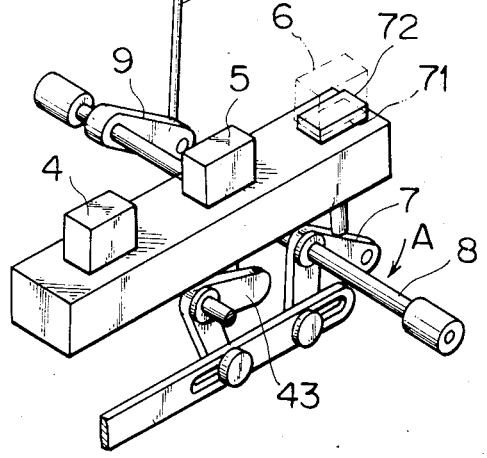
FIG. 2 is a perspective view of the outer operating parts and an upper thread adjusting mechanism of the first embodiment.
Figure 3:
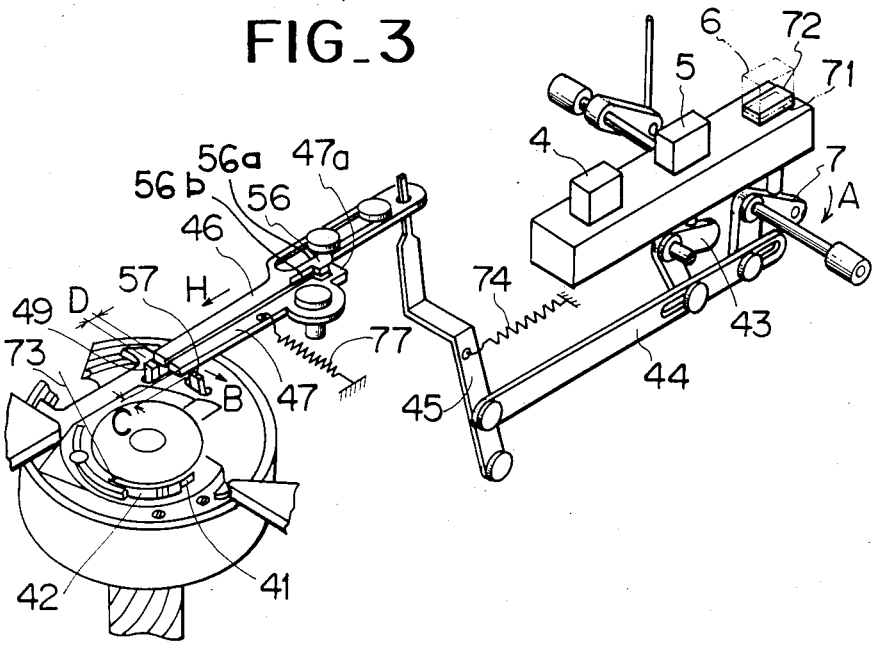
FIG. 3 is a perspective view of a lower thread adjusting mechanism.
Figure 4:
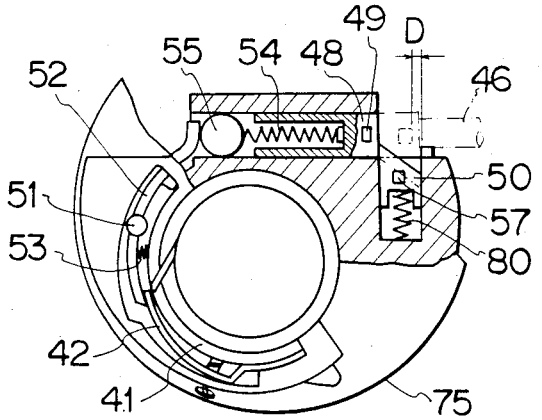
FIG. 4 is a loop taker device, partially in section.
Figure 5:
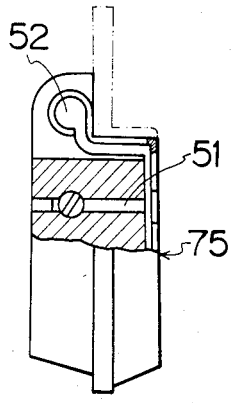
FIG. 5 is a side view of the loop taker device of FIG. 4.

A first embodiment of the invention is shown in FIGS. 1 to 5. Fabric sort buttons 4, 5, 6 are used to select "Thin", "Normal" and "Thick" depending on the fabric to be stitched. An auxiliary upper thread tension adjusting device is shown in FIG. 2 and is actuated only by selection of the "Thick" button 6 so as to heighten the tension of the upper thread by a certain amount. A lower thread tension adjusting device is shown in FIGS. 3 to 5 and is actuated by selection of the "Normal" button 5 or the "Thick" button 6 so as to heighten the tension of the lower thread by a certain amount. Thus, the first embodiment is composed of the above mentioned fabric sort buttons 4, 5, 6, the auxiliary upper thread tension adjusting device and the lower thread tension adjusting device.

FIG. 1 shows a machine frame 1 provided with a thread tension device 2 and the fabric sort buttons "Thin" 4, "Normal" 5 and "Thick" 6 operated in dependence on the thickness of the fabric being sewn. If any one of the buttons is selected, the other two are released. The buttons are each pushed down to a position 71 shown with a dotted line on the "Thick" button 6 of FIG. 2, and returned to a position 72 shown by a solid line and locked there.

The upper thread adjusting mechanism acts on an upper thread 19 from a thread supply 78 by means of the thread tension device 2 and the auxiliary thread tension device 14.

The "Thick" button 6 is contacted as its one end with a link 7 which in turn is mounted on a shaft 8 which holds a link 9 which is connected to a rod 10 cooperating with a link 11 pivoted to a machine frame 1, which is connected to a link 13 via a rod 12.

The auxiliary upper thread tension device 14 is attached to the machine frame 1, and the link 13 is connected at the other end to one part of the shaft of a spring receiving member 16 which is biased in one direction by a spring 15 within a case 17, so that an upper thread 19 is held between the lower surface of the case 17 and a disk 18 secured to the machine frame 17. A thread releasing lever 20 is connected to a press lever via a link mechanism (both not shown).

The lower thread adjusting mechanism, shown in FIGS. 3 to 5, is operated to increase or decrease pressure on a lower thread tension spring 42 which presses a lower thread 73 against the lower thread bed 41 so as to provide a determined lower thread tension.

The links 7 and 43 contact the buttons "Normal" 5 and "Thick" 6, and are connected to a rod 44 which is connected to a link 45 pivoted to the machine frame 1, link 45 being connected to an actuating lever 46. The link 45 is always biased by a spring 74 in the direction opposite to an arrow A, but the biasing force is sufficiently strong to push the fabric sort buttons back. The actuating lever 46 faces, at no signal, a pin 49 of a tube 48 of a bobbin carrier 75 with a space D for passing an upper thread loop at a position shown by the dotted line in FIG. 4.

The bobbin carrier 75 presses the lower thread 73 between the lower thread tension bed 41 and the lower thread tension spring 42. The tension spring 42 is contacted at its one end to a lever 52 which is rotated about a lever pin 51 as a fulcrum, and a small pin 53 is provided between the lever spring 51 and said contacting part of the lever 52. The lever 52 contacts, at its other end, a ball 55 which is biased by a spring 54 housed within the tube 48.

The numeral 50 designates a stopper which is slidably housed within the bobbin carrier 75 and provided with a spring 80, and it contacts the tube 48 by its end portion as shown with the dotted line in FIG. 4.

As is seen in FIG. 3, the numeral 47 is a resetting lever pivoted to the machine frame, and its end portion 47*a* is adapted to cooperate with a projected part 56*a* and a recessed part 56*b* of a cam face 56 of the actuating lever 46 by the biasing force of a resetting spring 77, while the other end portion of the resetting lever 47 is supported in relation with a stopper pin 57 with a space C for passing the upper thread loop therethrough.

By selecting the fabric sort "Thick" button 6, the link 7 is rotated in the arrow direction A in FIG. 2. The upper thread is adjusted in that the spring receiving member 16 presses the slide 81 via the rod 44 and link 45 against the biasing force of the spring 15, and the upper thread 19 is pressed by the holding pressure between the case 17 and the disk 18.

The lower thread is adjusted as seen in FIG. 3 in that the actuating lever 46 is pushed forward in the direction of arrow H via the rod 44 and the link 45 by the rotation of the link 7 in the direction of arrow A, so that the pin 49 is pushed, and the tube 48 is, as shown in FIG. 4, moved from the position shown by the dotted line to the position shown by the solid line against the biasing force of the spring 54, and at this time the stopper 50 is moved to the dotted lined position by the force of the spring 80, and the positioning of the tube 48 is determined. The pressure of the spring 54 is thereby made larger than that of the spring 53, so that the lever 52 is rotated about the lever pin 51 as the fulcrum to press down the lower thread adjusting spring 42, and thus the tension of the lower thread is set at "Strong". Since the fabric sort buttons are once pushed down to the position 71 and further to the position 72 for passing the upper thread loop, the actuating lever 46 pushes the pin 49 and locks the tube 48, and stops with a space D in relation with the pin 49.

The fabric sort "Thick" button 6 is released by selection of the "Normal" button 5. The link 7 is returned and the auxiliary upper thread tension device 14 is released, and the keeping force of the upper thread 19 is released. Then a slight tension due to the auxiliary tension device 14 may be residual as far as the drawing-out of the thread is not disturbed.

The adjustment of the lower thread is the same as the selection of the "Thick" button 6 by the rotation of the link 43 in the arrow direction A, and the tension of the lower thread is set at "Strong".

When the "Thin" button 4 is selected, the other buttons are released. The upper thread is the same at selection of the "Normal" button 5, and the auxiliary upper thread adjusting device 14 is released to release the thread from being held between the members 17 and 18.

If the "Normal" button 5 and the "Thick" button 6 are released, the spring 74 pushes back the actuating lever 46 in the direction opposite to the arrow H via the rod 44 and the link 45. At this time, the resetting lever 47 is rotated in the direction of arrow B by means of the recessed part 56*b* of the cam face 56 of the actuating lever 46 and the resetting spring 77, and pushes the stopper pin 57 in the direction of arrow B to retreat the stopper 50 to the dotted lined position so that the tube 48 can move to the dash dotted lined position and the spring 54 is returned to the initial condition. Under this condition, since the spring force of the small spring 53 is stronger than the spring force of the lever 54 in the spring 52 where the lever pin 51 is a fulcrum, the lever 52 is rotated and released from the lower thread tension spring, to set the tension of the lower thread at "Weak" condition.

With respect to the space for passing the upper thread loop, when the actuating lever 46 is returned to the position in the direction opposite to the arrow H, the resetting lever 47 is once rotated in the direction of arrow B due to the action of the cam face 56 of the actuating lever 46, and pushes the stopper pin 57 so that the tube 48 is released from locking, and the resetting lever 47 is slightly returned in the direction opposite to that of arrow B and stopped with the space C in relation with the stopper pin 57.

Figure 6:
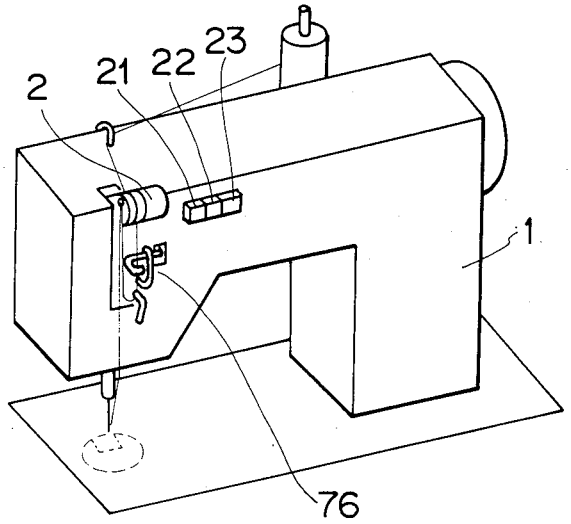
FIG. 6 is a schematic perspective view of a sewing machine showing outer operating parts thereof according to a second embodiment of the invention.
Figure 8:
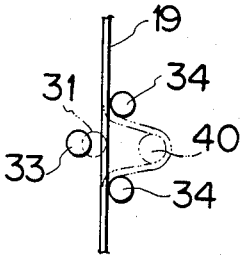
FIG. 8 is side view for an element giving tension to the upper thread.
Figure 7:
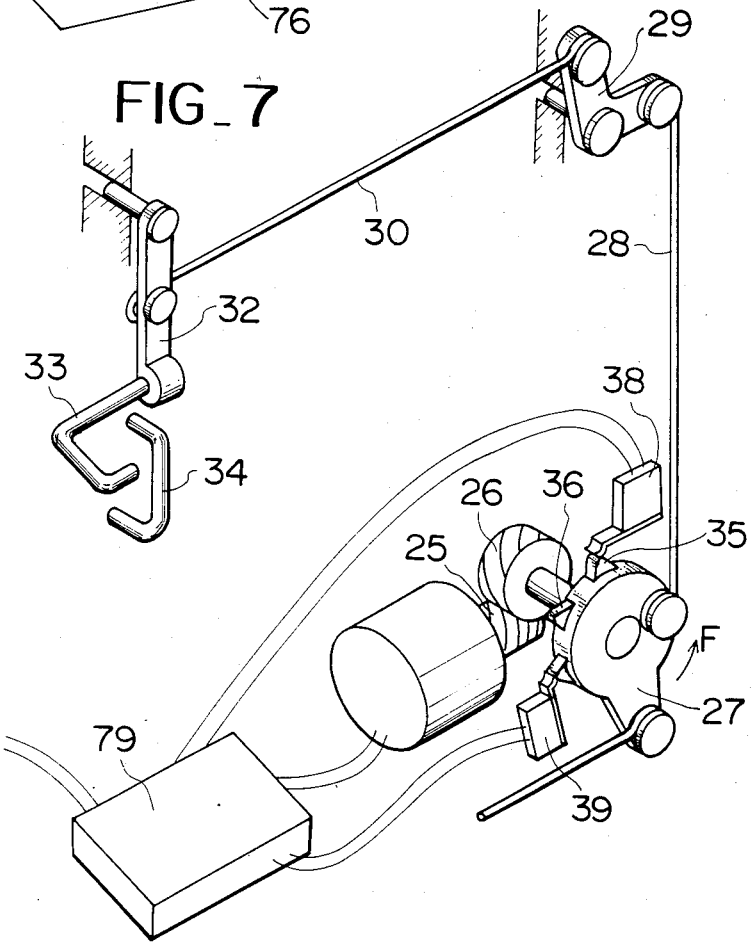
FIG. 7 is a perspective view of an upper thread adjusting mechanism of the machine of FIG. 6.
Figure 9:
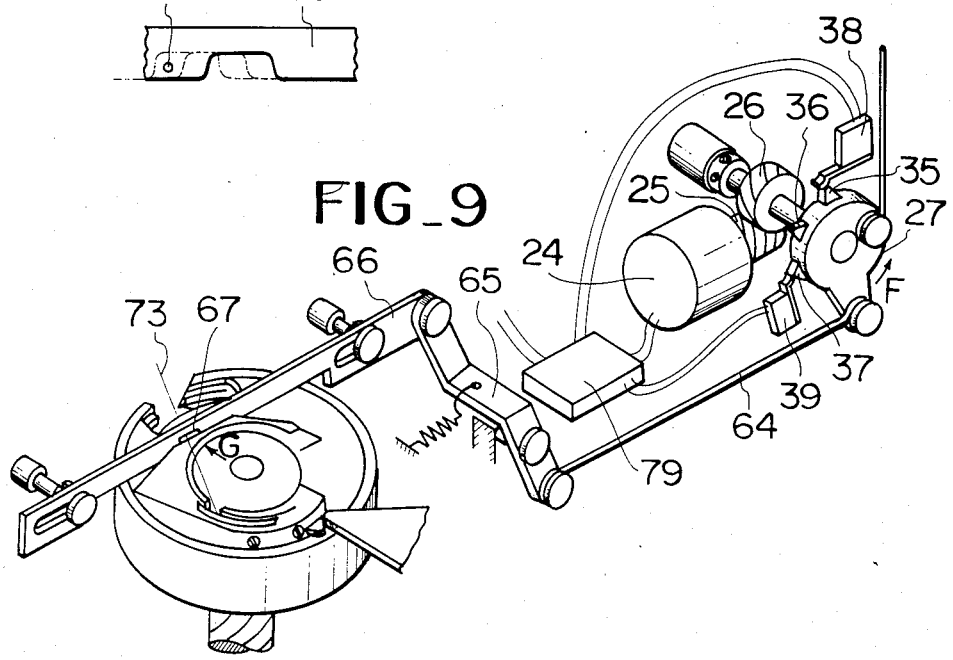
FIG. 9 is a perspective view of the lower thread adjusting mechnism of the second embodiment.
Figure 11:
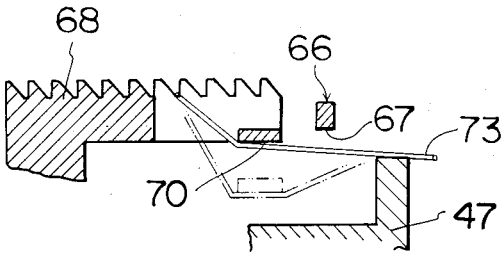
FIGS. 11 and 12 are views of the device for adjusting the amount of the supplied lower thread in different operational positions.

The second embodiment of the invention is shown in FIGS. 6 to 12, and is composed of an upper thread bending resistance device and a lower thread supplying amount adjusting device, and the former device being shown in FIG. 7 is actuated by selecting the "Thick" button 23 to increase the tension of the upper thread by a certain amount, and the latter device being shown in FIG. 9 is operated to increase the supplying amount of the lower thread by a certain amount.

As seen in FIG. 6, the machine frame 1 is provided with a thread tension device 2, a fabric sort "Thin" button 21, a "Normal" button 22 and a "Thick" button 23. If any one of the buttons is selected, the other two are released. Further, an electric signal is issued by the pressing operation.

The fabric sort "Thin" button 21, "Normal" button 22 and "Thick" button 23 are electrically connected to an electric circuit 79 and a motor 24 which rotates a rotor 27 via a worm 25 and a gear 26 as seen in FIGS. 7 and 9. The rotor 27 is connected to a rod 28 which is connected to a link 29 pivoted to the machine frame. The link 29 is connected to a link 32 pivoted to the machine frame via a rod 30. A thread guiding bar 33 secured to the link 32 and a fixed thread guide 34 form a bending resistance part.

The rotor 27 is formed with convexes 35, 36 and 37 for controlling rotating positions, and is provided with a micro-switch 38 in opposition to the convex 35 and a micro-switch 39 in opposition to the convex 39.

As shown in FIG. 9, the rotor 27 is connected to the rod 64 which is connected to a link 65 pivoted to the machine frame, which is connected to a lever 66 for limiting the supplying amount of the lower thread, and the lever 66 is formed with a recess 67 for adjusting the lower thread.

The motor 24 is driven by selecting the fabric sort "Thick" button 23 and rotates the rotor 27 in the direction opposite to an arrow F and stops the rotor at a position where the convex 37 acts on the micro-switch 38 from an initial setting position of the microswitch 39. The link 32 is moved via the rod 28, the link 29 and the rod 30. The thread guiding bar 33 held by a link 32 is moved from the position of the solid line of FIG. 8 to the position of the dotted line of the same, and the upper thread 19 is bent in relation with the fixed thread guide 34 so as to increase resistance so that the tension of the upper thread is heightened.

Figure 10:
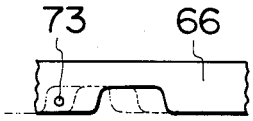
FIG. 10 is a view seen from an arrow G of FIG. 9.

The convex 37 of the rotor 27 is in FIG. 9 positioned to actuate the micro-switch 38, and the lever 66 for limiting the supplying amount of the lower thread is positioned via the rod 64 and the link 65 as shown with the solid line in FIG. 10. A part 69 of the lever 66 is positioned to interfere with the lower thread 73 as shown in FIG. 12 so as to decrease the supplying amount of the lower thread by a lower thread supplying part 70 of a feed dog 68.

By selection of the fabric sort "Normal" button 22, the "Thick" button 23 is released, the motor 24 is rotated, and the rotor 27 is rotated in the direction of arrow F and stopped at a position where the convex 36 acts on the micro-switch 38. With respect to the adjustment of the upper thread, the thread guiding bar 33 is returned to the position 31 shown by the dotted line (FIG. 8) via the rod and the link as shown in FIG. 8, so that the tension of the upper thread is not effected at the bending part.

Figure 12:
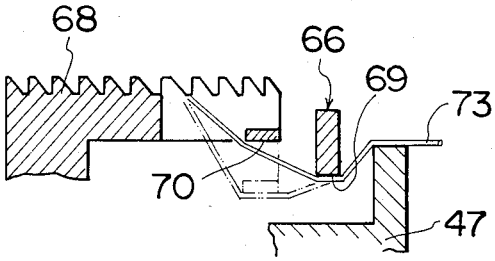

The convex 36 of the rotor 27 comes to the position acting on the micro-switch 38, and the lever 66 is positioned as shown with the dotted line in FIG. 10, and the part 69 interferes with the lower thread 73 as shown in FIG. 12 so as to decrease the supplying amount of the lower thread by the lower thread supplying part 70 of the feed dog 68.

By selection of the fabric sort "Thin" button 21, the "Normal" button 22 and the "Thick" button 23 are released, and the motor 24 is rotated. The rotor 27 is rotated in the direction of arrow F and stopped in the position where the convex 35 acts on the microswitch 38.

With respect to the upper thread, the thread guiding bar 33 is returned to the position shown by the solid line via the rod and the link as shown in FIG. 8 so as to release the tension of the upper thread at the bending part thereof.

The convex 35 of the rotor 27 comes to the position of acting on the micro-switch 38, and the lever 66 is set in the position where the supply of the lower thread by the feed dog 68 is not limited, that is, the position where the recess 67 of the lever 66 comes to the upper part of the lower thread 73. Under this condition, the lever 66 does not act on the supply of the lower thread 73 carried out by the vertical movement of the feed dog 68.

With respect to the adjustment of the lower thread, the amount of the vertical movement of the feed dog 68 is made larger than that in the coonventional sewing machine, such that when the "Normal" button 22 and the "Thick" button 23 are selected (i.e. when the supply of the lower thread is limited as shown in FIG. 12), the supply amount of the lower thread is set to be equivalent to that of the conventional sewing machine. The supply amount of the lower thread when the "Thin" button 21 is selected, is thereby greater than in conventional cases (since the supply is not limited), and it is possible to carry out the stitching with the tension of the upper thread which is weak.

For pressing up at increasing the tension of the upper thread in the second embodiment, it is not necessary to perform the operation for releasing the bending resistance. The increase of the tension by the resistance is caused by bending the thread, and the tension prior to said bending greatly influences the resistance to bendng. A bending resistance part is provided between the upper thread tension device 2 and the upper thread guide 76, and when thread tension prior to the bending does not exist or is very little by loosening the thread together with said upward pressing, the thread tension is not increased by the bending.

Figure 13:
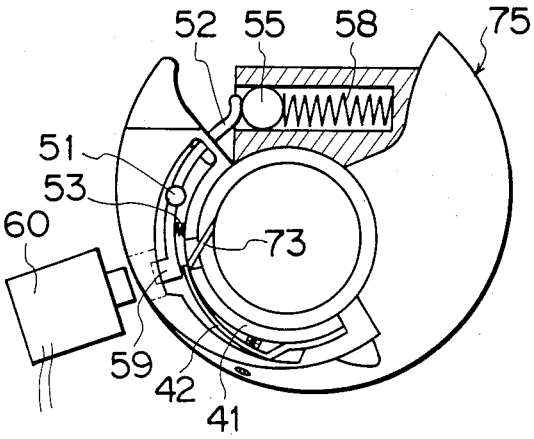
FIG. 13 is a structure of a loop taker device to be used in another embodiment for adjusting the lower thread.
Figure 15:
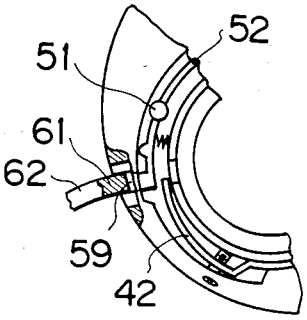
FIG. 15 and 16 are views showing elements for actuating the operating members of FIG. 14.
Figure 14:
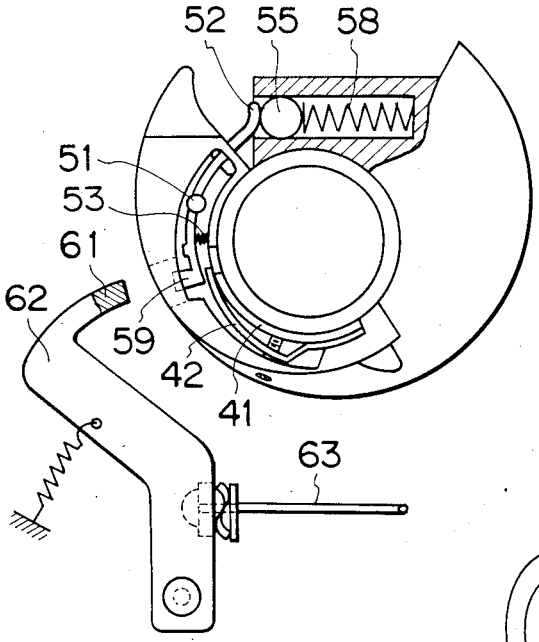
FIG. 14 is a view similar to that of FIG. 13 where the operating members of FIG. 13 are changed.
Figure 16:
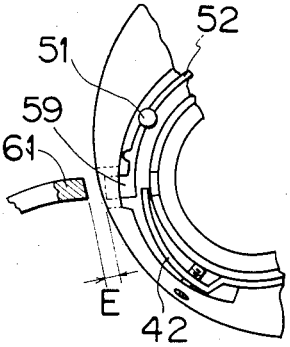

In yet another embodiment of the lower thread adjustment, the lower thread 73 is, as shown in FIG. 13, controlled by a solenoid 60 for the lower thread tension spring 42 pressing the lower thread 73 in relation with the lower thread tension bed 41. The bobbin carrier 75 presses the lower thread 73 between the lower thread tension bed 41 and the lower thread tension spring 42, and is provided with the lever 52 rotatable about the lever pin 51, the small spring 53 and the ball 55 biased by the spring 48. The lever 52 is formed with a convex 59 in opposition to the Solenoid 60 which is electrically connected to the electric circuit 79 and the fabric sort buttons. When the fabric sort "Thin" button 21 is selected, the solenoid 60 attracts the convex 59 of the lever 52 with a space E for passing the upper thread loop, and releases the pressure of the spring 58 and sets the tension of the lower thread at."Weak". When the "Normal" button 22 and the "Thick" button 23 are selected, the attraction of the solenoid is cancelled. In the lever 52 rotating about the fulcrum of the lever pin 51, the spring 58 is set to be stronger than the small spring 53, and therefore the lever 52 presses down the lower thread tension spring 42 so as to set the lower thread tension at "Strong". This manner may be applied to the first embodiment. As is seen in FIG. 14, a link 62 having a magnet at its end 61 may be rovided instead of the solenoid 60.

The selection of the same fabric sorts is carried out in the manner as that of FIG. 1, and the "Thin" button 4 and the link 62 are connected via the rod 63. When the "Thin" button 4 is selected, the link 62 enters the bobbin carrier 75 as seen in FIG. 13, and attracts the convex 59 of the lever 52 and retreats, and stops in the range of available attraction of the magnet 61 and with the space E, and releases the pressure by the lever 52 to the lower thread tension spring 42, and sets the lower thread tension at "Weak" with the pressure of the lower thread tension spring only. By selection of the "Normal" button 5 and the "Thick" button 6, the "Thin" button 4 is released, and the link 62 retreats to the position where the attraction is not available to the convex 59 and stops there. The lever 52 presses the lower thread tension spring 42 by the biasing force of the spring 58, and sets the lower thread tension at "Strong".

Figure 17:
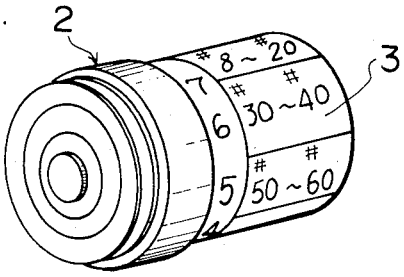
FIG. 17 is a perspective view of an upper thread tension device with thicknesses of the threads shown thereon.

In the first and second embodiments of the invention, the upper thread tension device is the foregoing one, and as shown in FIG. 17 an upper thread tension device 2 has a portion 3 showing the numbers of the upper or lower thread, which may be used at a position corresponding to the scales of the upper thread tension device in view of the relation between the upper thread or lower thread and the proper tension of the upper thread.

As mentioned above a specific tension selection is made according to the fabric or thread type being used. Especially for thin material a lower thread tension setting at the "weak" condition precludes material shrinkage from too high a tension setting.

We claim:

1. In a sewing machine of the type having a machine frame, means for supplying an upper thread, means for supplying a lower thread, and means for setting thread tension, the thread tension setting means comprising selecting means for selecting a thread tension in response to a thickness of a fabric being sewn and mounted to the machine frame; upper thread tension adjusting means positioned on same frame and operatively connected to said selecting means and actuated thereby to adjust the tension of the upper thread in response to the thickness of the fabric; and lower thread tension adjusting means operatively connected to said selecting means to adjust the tension of the lower thread in response to the thickness of the fabric being sewn, said thread tension adjusting means including a cup shaped case, a spring receiving member, a spring mounted on said spring receiving member, a disk attached to said case and a first link means interconnected between said selecting means and said thread tension adjusting means, the upper thread being received between said disc and said case from the upper thread supply means.

2. The sewing machine as defined in claim 1, wherein said lower thread tension adjusting means includes a lower thread tension adjusting lever movable toward and away from said lower thread supply means and a second link means interconnected between said lower thread tension adjusting lever and said selecting means.

3. The sewing machine as defined in claim 2, wherein said lower thread tension adjusting means further includes a spring-biased ball connecting said lower thread tension adjusting lever to said link means.

4. The sewing machine as defined in claim 1, wherein said selecting means includes a plurality of buttons which are selectively operated in response to the thickness of the fabric being sewn.

5. In a sewing machine of the type having a machine frame, means for supplying an upper thread, means for supplying a lower thread and means for setting thread tension, the thread tension setting means comprising selecting means for selecting a thread tension in response to a thickness of a fabric being sewn and mounted to the machine frame; upper thread tension adjusting means on said frame and operatively connected to said selecting means and actuated thereby to adjust the tension of the upper thread in response to the thickness of the fabric; and lower thread tension adjusting means operatively connected to said selecting means to adjust the tension of the lower thread in response to the thickness of the fabric being sewn, said upper thread tension adjusting means means including a cup-shaped case, a spring-receiving member, a spring mounted on said spring receiving member, a disk attached to said case and a first link means interconnected between said selecting means and said thread tension adjusting means, the upper thread being received between said disk and said case from the upper thread supply means and being fed to said upper thread tension adjusting means, said lower thread tension adjusting means including a lower thread tension adjusting lever movable toward and away from the lower thread supply means and a second link means interconnected between said lower thread tension adjusting lever and said selecting means.

* * * * *